US011352788B2

(12) United States Patent
Simonic

(10) Patent No.: US 11,352,788 B2
(45) Date of Patent: Jun. 7, 2022

(54) EDGE PROFILE FOR FORMING A PART OF A SUSPENDED CEILING SUBSTRUCTURE AND A SUSPENDED CEILING SUBSTRUCTURE

(71) Applicant: Knauf Gips KG, Iphofen (DE)

(72) Inventor: Boris Simonic, Rijeka (HR)

(73) Assignee: Knauf Gips KG, Iphofen (DE)

( * ) Notice: Subject to any disclaimer, the term of this patent is extended or adjusted under 35 U.S.C. 154(b) by 64 days.

(21) Appl. No.: 15/754,230

(22) PCT Filed: Sep. 8, 2015

(86) PCT No.: PCT/EP2015/001806

§ 371 (c)(1),
(2) Date: Feb. 21, 2018

(87) PCT Pub. No.: WO2017/041810

PCT Pub. Date: Mar. 16, 2017

(65) Prior Publication Data

US 2019/0017267 A1 Jan. 17, 2019

(51) Int. Cl.
*E04B 9/18* (2006.01)
*E04B 9/10* (2006.01)
(Continued)

(52) U.S. Cl.
CPC ..... *E04B 9/18* (2013.01); *E04B 9/16* (2013.01); *E04B 9/30* (2013.01); *E04B 9/0435* (2013.01); *E04B 9/10* (2013.01); *E04B 9/225* (2013.01)

(58) Field of Classification Search
CPC ... E04B 9/18; E04B 9/10; E04B 9/067; E04B 9/225; E04B 9/30; E04B 9/0435
See application file for complete search history.

(56) References Cited

U.S. PATENT DOCUMENTS 1,779,564 A * 10/1930 Slagel ..... F25D 23/006 248/318
3,084,401 A * 4/1963 Findlay ..... E04B 9/122 181/284
(Continued)

FOREIGN PATENT DOCUMENTS

CA 2132759 A1 3/1996
DE 2640555 A1 3/1978
(Continued)

OTHER PUBLICATIONS

Written Opinion of the International Search Authority, PCT/2015/001806, dated Mar. 16, 2017, downloaded from the WIPO web site.

*Primary Examiner* — Phi D A
(74) *Attorney, Agent, or Firm* — Mark Terry

(57) ABSTRACT

Edge profile 10 for forming a part of a suspended ceiling substructure comprising a plurality of support profiles arranged suspended from a raw ceiling of a building structure and a plurality of base profiles, each of which being attached to at least one of the plurality of support profiles, the edge profile 10 having a U-shaped cross-section with a base portion 11 capable of being fixed to a wall structure, a first leg portion 12 and a second leg portion 13, the first leg portion 12 having an outer section 122 and an inner section 121, wherein the outer section 122 is arranged offset towards the second leg portion 13 relative to the inner section 121.

16 Claims, 3 Drawing Sheets

Figure 1:
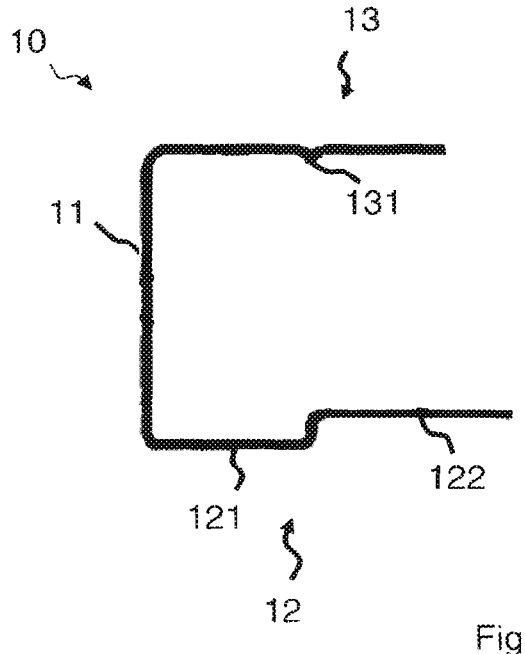

(51) Int. Cl.

| | |
|---|---|
| ***E04B 9/30*** | (2006.01) |
| ***E04B 9/16*** | (2006.01) |
| *E04B 9/04* | (2006.01) |
| *E04B 9/22* | (2006.01) |

(56) References Cited

U.S. PATENT DOCUMENTS 4,274,615 A * 6/1981 Chan ..... F21V 21/04 248/343
4,829,410 A * 5/1989 Patel ..... F21V 21/04 362/147
5,039,039 A * 8/1991 Schaffer ..... F16L 3/22 248/218.4
5,572,844 A * 11/1996 Stackenwalt ..... E04B 9/127 52/506.07
5,713,157 A * 2/1998 van Leeuwen ..... E04B 9/006 248/201
5,746,507 A * 5/1998 Lee ..... F21V 21/04 362/147
7,530,705 B2 * 5/2009 Czech ..... F21S 8/02 248/288.11
7,971,840 B2 * 7/2011 Hirschhorn ..... F16M 11/14 248/281.11
8,316,600 B2 * 11/2012 Wendt ..... E04B 9/30 52/287.1
8,506,134 B2 * 8/2013 Wilson ..... F21V 21/04 362/366
8,763,322 B2 * 7/2014 Hamamura ..... F24S 25/636 52/173.3
8,813,457 B2 * 8/2014 Underkofler ..... E04B 9/30 52/712
8,820,026 B2 * 9/2014 Underkofler ..... E04B 9/30 52/712
2002/0083655 A1 * 7/2002 Paul ..... E04B 9/122 52/105
2004/0111995 A1 * 6/2004 Dockery ..... E04B 9/205 52/506.08
2004/0172907 A1 * 9/2004 Krantz-Lilienthal ... E04B 9/064 52/506.05
2005/0183559 A1 * 8/2005 Rue ..... B23D 49/08 83/574
2007/0283656 A1 * 12/2007 Anderson ..... E04B 9/303 52/506.06
2010/0064618 A1 * 3/2010 Boyd ..... E04B 9/225 52/506.07
2011/0011023 A1 * 1/2011 Gulbrandsen ..... E04B 9/065 52/506.07
2012/0304574 A1 * 12/2012 Gulbrandsen ..... E04B 9/067 52/506.07
2013/0126681 A1 * 5/2013 Greenfield ..... F16L 3/11 248/62
2014/0000205 A1 * 1/2014 Underkofler ..... E04B 9/30 52/588.1
2014/0367137 A1 * 12/2014 Leung ..... F16M 11/2014 174/68.3
2015/0308617 A1 * 10/2015 Sareyka ..... E04B 9/127 52/506.07
2018/0058068 A1 * 3/2018 Bergman ..... E04B 9/242

FOREIGN PATENT DOCUMENTS

DE 4025189 A1 2/1992
EP 2034101 A2 3/2009
JP HO9105200 A 4/1997

* cited by examiner

EDGE PROFILE FOR FORMING A PART OF A SUSPENDED CEILING SUBSTRUCTURE AND A SUSPENDED CEILING SUBSTRUCTURE

The invention relates to an edge profile for forming a part of a suspended ceiling substructure as well as to a suspended ceiling substructure according to the respective independent claims.

The technical field of the invention is drywall building structures and in particular earthquake-proof drywall ceilings having a suspended ceiling substructure to which building boards are mounted to form a closed ceiling surface.

In general, such a suspended ceiling substructure is formed by bent sheet metal profiles and includes—in case of a drywall ceiling support—support profiles, base profiles as well as edge profiles.

The support profiles are fixed to the raw ceiling in a suspended manner by use of hangers. A typical hanger has a holder portion which is clamped to a hanger wire. Normally each support profile is suspended by means of at least two hangers which are screwed to the raw ceiling with the hanger wire. In the mounted state, the support profiles additionally rest with their end portions on edge profiles.

The base profiles are attached to support profiles. Common base profiles are U-shaped with two leg portions which can be clipped into a corresponding shaped portion at the lower side of the support profile. In one particular example, a plurality of base profiles is attached to the support profiles in a grid like manner having a distance between adjacent base profiles of about 60 cm. Plasterboards are screwed to the base profiles to form the closed ceiling surface.

The edge profiles are fixed to the inner walls at a height which corresponds to the support profiles so that in the mounted state, the support profiles rest with the end portions on the edge profiles. Conventional edge profiles have an L-shaped cross-section with a base portion and a single leg portion extending therefrom. The base portion is of a flat shape and has a size so as to be capable of being fixed to a wall structure at the height which corresponds to the support profiles in the mounted state. The leg portion extends in the mounted state of the edge profile from the inner wall into the room so that the support profile rests on the upper surface of the leg portion.

A certain type of L-shaped edge profile improves the stability of the suspended ceiling substructure by that the leg portion is formed with an outer section and an inner section. The outer section is arranged further inside (towards the angle bisector) relative to the inner section. This allows resting the support profile onto the upper surface of the outer section while the plasterboards are mounted from below in contact with the lower surface of the inner section.

In seismic active geographical regions, like for example in Japan or Nepal, such drywall building structures have to withstand movements of a building caused by the movement of the ground during earthquakes. Earthquake-proof drywall designs are required for such earthquake-prone locations. Earthquake-proof drywall designs aim to provide life safety to occupants and maintain building function during and after an earthquake.

The above described L-shaped edge profile is disadvantageous insofar as during such a movement caused by seismic activity, the support profile can vertically move from the edge profile. During a strong earthquake, the support profile can even be lifted from the L-shaped edge profile and drop in into the room below. Such a ceiling can fall down on occupants or block the way out of a building.

Hence it is an object of the invention to provide an improved edge profile which overcomes or at least reduces the disadvantages known from the prior art. In particular it is an object of the invention to provide an edge profile for an earthquake-proof ceiling construction.

The object of the invention is achieved by an edge profile and a suspended ceiling substructure according to the respective independent claims. Single advantageous aspects of the invention form the subject matter of the respective dependent claims.

The invention relates to an edge profile forming part of a suspended ceiling substructure comprising a plurality of support profiles arranged suspended from a raw ceiling of a building structure and a plurality of base profiles, each of which being attached to at least one of the plurality of support profiles. The edge profile has a U-shaped cross-section comprising a base portion capable of being fixed to a wall structure, a first leg portion and a second leg portion. The first leg portion preferably has an outer section and an inner section, wherein the outer section is arranged offset towards the inner section and relative to the second leg portion. Thus, the outer section preferably is arranged further inside and closer to the second leg portion than the inner section.

According to the invention, an edge profile for an earthquake-proof ceiling construction is provided which allows for (fixedly) arranging the end protions of support profiles between of the outer section of the first leg portion and the second leg portion. In particular this is of advantage during seismic movement, since the support profile cannot vertically move. In case of a strong earthquake, the support profile is vertically fixed between the first leg portion and the second leg portion and cannot be lifted or even drop therefrom into the room below. The invention provides the advantages of known L-shaped edge profiles with improved stability (due to the leg portion formed with an outer section and an inner section for resting the support profile onto the upper surface of outer section while the building boards are mounted from below in contact with the lower surface of the inner section) in combination with the advantages of an earthquake-proof drywall ceiling construction.

The building boards according to the invention can comprise gypsum plasterboards, gypsum fiberboards, cement boards, vermiculite boards, silicate boards, and magnesium oxide boards. In the following and for the sake of simplicity only, the expression "plasterboard" is used although all other building boards can also be used.

According to a preferred embodiment, the outer section of the first leg portion is parallel to the second leg portion. The parallel arrangement allows for inserting the end portion of the support profile in the space between the outer section and the second leg portion being in contact with both.

It is preferred that the outer section of the first leg portion and the second leg portion are arranged parallel in a distance of 30 mm to 50 mm. The distance can be chosen according to the height of the support profile so that it fits into the space between the outer section of the first leg portion and the second leg portion. A particularly preferred size for the distance between the outer section of the first leg portion and the second leg portion is 40 mm.

Advantageously, the inner section of the first leg portion has a length which is shorter than the length of the outer section. This arrangement allows to minimize the size of the inner section and to maximize the size of the outer section.

This is of advantage since a large outer section provides a large resting surface for the end portion of the support profile.

Particularly preferred, the inner section has a length of 15 mm to 25 mm and the outer section has a length of 25 mm to 35 mm. More particularly preferred, the inner section has a length of 20 mm and the outer section has a length of 30 mm. This length of the outer section has shown to provide a sufficient resting surface for the support profile.

According to an advantageous aspect, the base portion has a length of 35 mm to 55 mm. The size of the base portion can be chosen to correspond to the height of the support profile. Further, the size of the base portion needs to be large enough to allow for screwing the edge profile to the wall and to provide sufficient area for supporting the edge profile.

Further preferred, the second leg portion comprises an abutment edge extending inwardly towards the first leg portion. The abutment portion can be formed by an inwardly bent edge or kink in the sheet metal profile. The abutment portion is arranged to be in contact with the front end of the support profile when it is arranged inside the edge profile in the mounted state.

It is preferred if the abutment edge is arranged in a distance from the base portion which corresponds to the length of the inner section of the first leg portion. This position of the abutment edge allows for arranging the support profile in contact thereto while being in contact with the entire upper surface of the outer section of the first leg portion.

The invention further relates to a suspended ceiling substructure comprising a plurality of support profiles to be arranged suspended from a raw ceiling of a building structure and a plurality of base profiles, each of which being attached to at least one of the plurality of support profiles. The suspended ceiling substructure further comprises at least one edge profile as described above.

Advantageously, the inner section and the outer section of the first leg portion of the edge profile are arranged parallel with an offset distance which corresponds (in the mounted state of the suspended ceiling substructure) to the distance between a (common) lower surface of the support profiles and a (common) lower surface of the plurality of attached base profiles. This allows resting the support profile onto the upper surface of the outer section while the plasterboards are mounted from below in contact with the lower surface of the inner section.

According to a preferred aspect, each support profile comprises at least one hanger for arranging the support profile at a raw ceiling of a building structure. Such a hanger comprises a holder portion which is clamped to a hanger wire. A further clip can be fastened to the hanger in the mounted state to mechanically secure the support profile to the hanger.

Another preferred aspect relates to at least one further edge profile having an L-shaped cross section. In the mounted state of the suspended ceiling substructure, the support profiles are arranged with their end portions in the U-shaped edge profiles, while the end portions of the base profiles are supported by L-shaped profiles. No U-shaped edge profiles are needed to secure the position of the base profiles if the support profiles are fixed in edge profiles according to the invention.

The invention further relates to a drywall ceiling comprising a suspended ceiling substructure as described above and at least one layer of building boards, especially plasterboards and in particular gypsum plasterboards, attached thereto. This aspect allows realizing the advantages of the invention concerning movements of the drywall ceiling due to seismic activity. This earthquake-proof drywall ceiling does not fall on occupants or blocks the way out of a building during an earthquake.

Preferably, the drywall ceiling comprises at least one layer of plasterboards attached and at least one further edge profile having an L-shaped cross section, wherein a portion of the further edge profile is arranged between the plasterboards and the base profiles of the suspended ceiling substructure.

In another embodiment the drywall ceiling comprises at least two layers of plasterboards which are attached to the base profiles and at least one further edge profile having an L-shaped cross section, wherein a portion of the further edge profile is arranged between individual layers of plasterboards of the two layers of plasterboards.

Advantageously, the plasterboards adjacent to the edge profile are attached to at least one base profile and to the lower surface of the inner section of the first leg portion.

Figure 2:
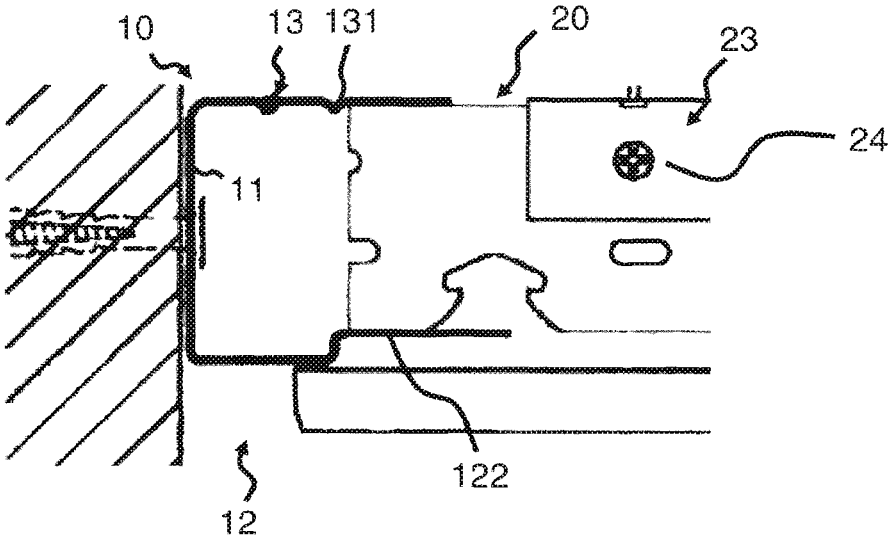
Figure 3:
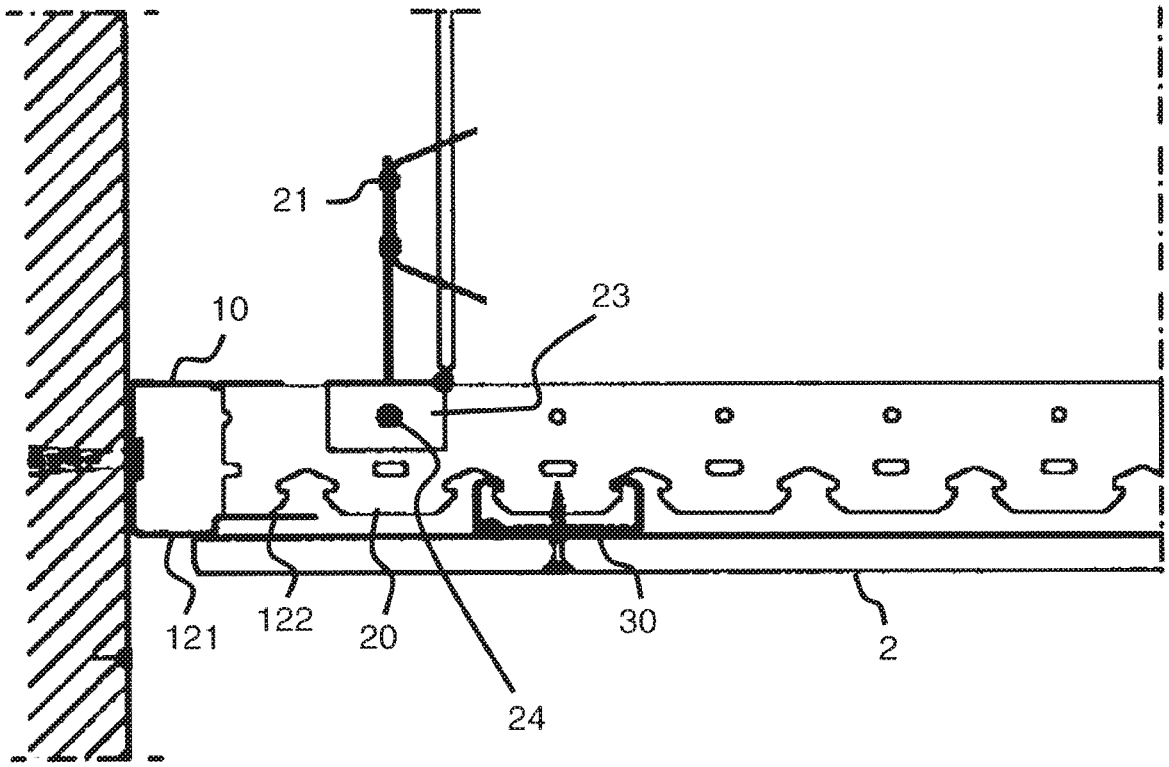
Figure 4:
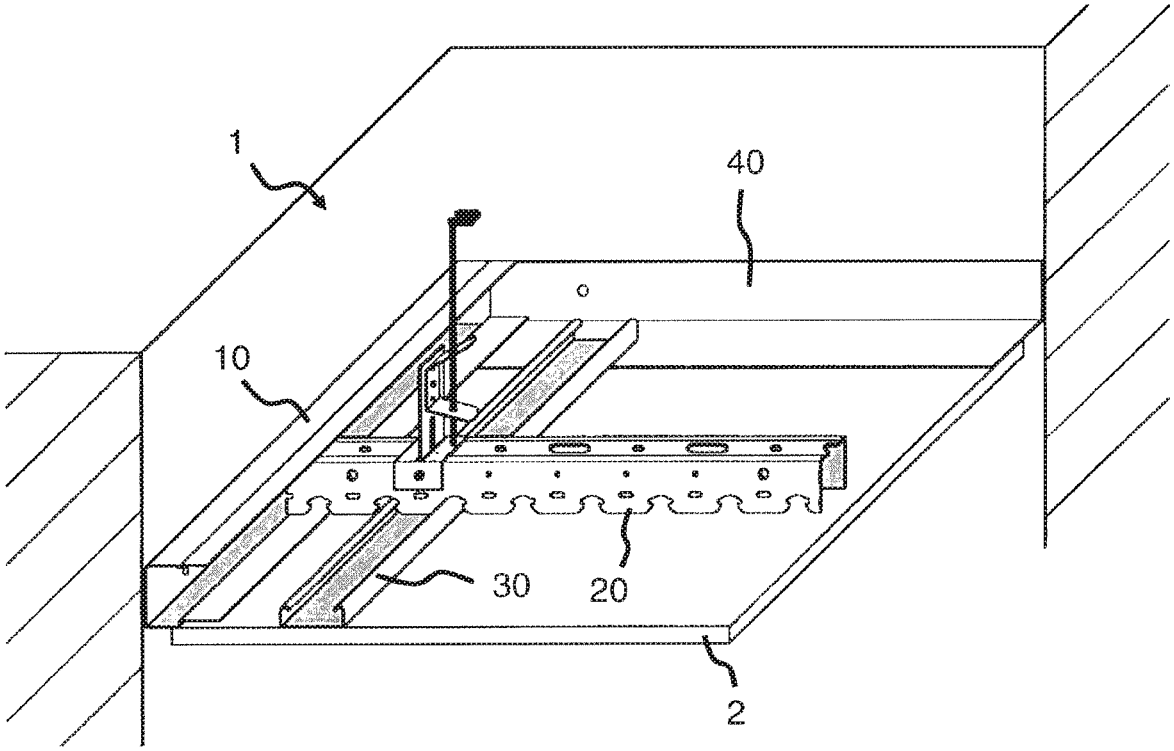
Figure 5:
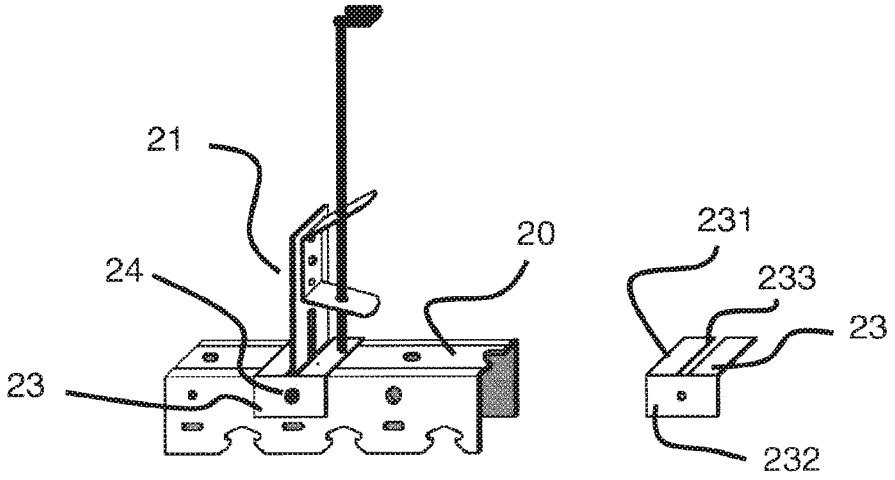

In the following the invention will be explained in more detail with reference to drawings. Like reference numerals denote similar features throughout the drawings. is the drawings show:

FIG. 1 a sectional view of an edge profile according to the invention;

FIG. 2 a sectional view of an earthquake-proof drywall ceiling with a substructure comprising the edge profile of FIG. 1;

FIG. 3 a sectional view of an earthquake-proof drywall ceiling with a substructure comprising the edge profile of FIG. 1;

FIG. 4 a perspective view of an earthquake-proof drywall ceiling with a substructure comprising the edge profile of FIG. 1; and FIG. 5 a close-up of a hanger and a securing clip according to the invention.

An edge profile 10 as shown in the sectional view of FIG. 1 has a u-shaped cross-section with a base portion 11 which is screwed in the mounted state to a wall structure (see FIG. 2). Edge profile 10 has at the lower side a first leg portion 12 and on the upper side a second leg portion 13. The first leg portion 12 extends from base portion 11 with and inner section 121 and an adjacently arranged outer section 122. First leg portion 12 is formed as a step, wherein outer section 122 is arranged closer to the second leg portion 13 than the inner section 121.

The outer section 122 of the first leg portion 12 is arranged parallel to the second leg portion 13 so that a support profile (see FIG. 2) can be inserted between the inner surfaces of both. The distance between the outer section 122 and the second leg portion 13 is about 40 mm which corresponds to the height of a standard support profile height. Inner section 121 of the first leg portion 12 has a length which is shorter than the length of the outer section 122. In the depicted example the inner section 121 has a length of about 20 mm, the outer section 122 has a length of about 30 mm and the base portion 11 has a length of about 45 mm.

The second leg portion 13 comprises an abutment edge 131 or kink extending inwardly towards first leg portion 12. The abutment edge 131 is of a size and shape to form a stop for the front surface of the inserted support profile (see FIG. 2). The abutment edge 131 is arranged in a distance from the base portion 11 which corresponds to the length of inner section 121 of the first leg portion 12. This arrangement allows for inserting the support profile along the entire length of the outer section 122 into the space between the outer section 122 of the first leg portion 12 and the second leg portion 13.

According to the invention, the edge profile 10 can be provided as part of an earthquake-proof ceiling construction. The edge profile 10 allows for arranging a support profile (as shown in FIG. 2) between the outer section 122 of first leg portion 12 and second leg portion 13. During a seismic movement, the support profile is prevented from moving vertically. In case of a strong earthquake, the support profile is vertically fixed between of the first leg portion 12 and the second leg portion 13 and cannot be lifted or even drop therefrom into the room below. The invention provides the advantages of known L-shaped edge profiles with improved stability (due to the first leg portion being formed with an outer section 122 and an inner section 121 for resting the support profile onto the upper surface of outer section 122 while the plasterboards 2 are mounted from below in contact with the lower surface of the inner section 121) and the advantages of an earthquake-proof drywall ceiling construction.

FIG. 2 shows a part sectional view of a drywall ceiling with a substructure comprising the edge profile 10 described in FIG. 1. The drywall ceiling comprises an u-shaped edge profile 10 screwed to a wall. The support profile 20 is inserted between the outer section 122 of the first leg portion 12 and the second leg portion 13 such that the front end of the support profile 20 contacts the abutment edge 131.

FIG. 3 is a larger view on the section of the ceiling in FIG. 2 and shows the arrangement of the plasterboard in an earthquake-proof ceiling according to the invention. Each support profile 20 comprises at least two hangers 21 for arranging the support profile 20 at a raw ceiling (not shown in the present illustration) of a building structure. Such a hanger 21 has a holder portion which is clamped to a hanger wire. A securing clip 23 can be fastened to the hanger in the mounted state to mechanically fasten the support profile 20 to the hanger 21. Preferably, the securing clip 23 is mechanically fastened to the support profile 20 by a self-tapping steel screw 24 after final positioning the hanger 21 in the slot of the support profile 20. This securing clip 23 provides further earthquake-stability to the suspended ceiling by preventing the separation of the support profile 20 from the hanger 21 due to movements in three directions during earthquakes.

This means that dynamic movements (x-y-z axis) as expected during an earthquake cannot separate the hanger 21 from the support profile 20. The design of the securing clip 23 allows for precise and effortless positioning and a save fixing with standard self-tapping steel screws 24 to the support profile 21.

Advantageously, inner section 121 and outer section 122 of edge profile 10 are arranged parallel with an offset distance which corresponds (in the mounted state of the suspended ceiling substructure) to the distance between a (virtual common) lower surface of the support profiles 20 and a (virtual common) lower surface of the attached base profiles 30. This allows resting the support profile 20 onto the upper surface of outer section 122 while the plasterboards 2 are mounted from below in contact with the lower surface of inner section 121.

A perspective view of a drywall ceiling with a substructure comprising the edge profile 10 of FIG. 1 is shown in FIG. 4. The suspended ceiling substructure of the ceiling comprises support profiles 20 suspended via hangers from a raw ceiling (not shown in the present illustration) of a building structure and a plurality of base profiles 30. In the shown example one layer of plasterboards 2 is attached to the base profiles 30 from below. The end portion of the support profile 20 is arranged in the edge profile 10. Parallel to the support profile 20 a further edge profile 40 having an L-shaped cross section is fixed to the wall. This further edge profile 40 supports the end portions of the base profiles 30. It is generally arranged on the walls perpendicular to the walls where the profile 10 fixed. Of course, the angle between the edge profiles 10, 40 depends on the angle between the support profile 20 and the base profile 30.

FIG. 5 shows a close-up of the securing dip 23 for securing a support profile 20 suspended from a raw ceiling by a hanger 21 to the support profile 20. The securing clip 23 has a first 231 and a second leg portion 232 arranged in an L-shape, the first leg portion 231 being longer than the second leg portion 232, and comprising a slot 233 open to one small end of the first leg portion 231 to slidably fix the securing clip 23 over the support profile 20 by arranging the hanger 21 in the slot 233.

The securing clip 23 can be fastened to the support profile 20 by a securing means 24. The securing means 24 can be a screw, a pin, a rivet or similar. Preferably, the securing means is self-tapping screw.

The invention claimed is:

1. Edge profile forming part of a suspended ceiling substructure comprising a plurality of support profiles arranged suspended from a raw ceiling of a building structure and a plurality of base profiles, each of which being attached to at least one of the plurality of support profiles, the edge profile having a U-shaped cross-section comprising a base portion capable of being fixed to a wall structure, a first leg portion and a second leg portion, the first leg portion having an outer section and an inner section, wherein the outer section is arranged offset towards the inner section and relative to the second leg portion, and wherein the outer section is arranged closer to the second leg portion than the inner section.

2. Edge profile according to claim 1, wherein the outer section of the first leg portion is parallel to the second leg portion.

3. Edge profile according to claim 2, wherein the outer section and the second leg portion are arranged in parallel in a distance of 30 mm to 50 mm.

4. Edge profile according to claim 1, wherein the inner section of the first leg portion has a length which is shorter than the length of the outer section.

5. Edge profile according to claim 1, wherein the inner section has a length of 15 mm to 25 mm, and the outer section has a length of 25 mm to 35 mm.

6. Edge profile according to claim 1, wherein the second leg portion comprises an abutment edge extending inwardly towards the first leg portion.

7. Edge profile according to claim 1, wherein the abutment edge is arranged in a distance from the base portion which corresponds to the length of the inner section of the first leg portion.

8. Edge profile according to claim 1, further including a suspended ceiling substructure comprising a plurality of support profiles to be arranged suspended from a raw ceiling of a building structure and a plurality of base profiles each of which being attached to at least one of the plurality of support profiles, wherein the suspended ceiling substructure further comprises at least one edge profile.

9. Suspended ceiling substructure according to claim 8, wherein the inner section and the outer section of the first leg portion of the edge profile are arranged parallel having an offset distance which corresponds to the distance between a lower surface of the plurality of support profiles and a lower surface of the plurality of attached base profiles.

10. Suspended ceiling substructure according to claim 8, wherein each support profile comprises at least one hanger for arranging the support profile at a raw ceiling of a building structure.

11. Suspended ceiling substructure according to claim 9, comprising at least one further edge profile having an L-shaped cross section.

12. Drywall ceiling comprising a suspended ceiling substructure according to claim 9 and at least one layer of building boards, comprising gypsum plasterboards, gypsum fiberboards, cement boards, vermiculite boards, silicate boards, and magnesium oxide boards attached to the base profiles.

13. Drywall ceiling according to claim 12, comprising one layer of building boards attached to the base profiles and at least one further edge profile having an L-shaped cross section, wherein a portion of the further edge profile is arranged between the building boards and the base profiles.

14. Drywall ceiling to claim 13, comprising at least two layers of building boards attached to the base profiles and at least one further edge profile having an L-shaped cross section, wherein a portion of the further edge profile is arranged between individual layers of building boards of the two layers of building boards.

15. Drywall ceiling according to claim 12, further comprising a securing clip fixing the hanger to the support profile.

16. Edge profile according to claim 1, further including a set for earthquake-proof construction of a drywall ceiling, comprising at least an edge profile and at least one securing clip.

* * * * *